US008391745B2

(12) United States Patent
Nishikawa et al.

(10) Patent No.: US 8,391,745 B2
(45) Date of Patent: Mar. 5, 2013

(54) CLEANING BODY, CLEANING DEVICE, CHARGING DEVICE, ASSEMBLY, AND IMAGE FORMING DEVICE

(75) Inventors: Hiroshi Nishikawa, Kanagawa (JP); Mikio Yamaguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

(21) Appl. No.: 12/902,920

(22) Filed: Oct. 12, 2010

(65) Prior Publication Data

US 2011/0170902 A1 Jul. 14, 2011

(30) Foreign Application Priority Data

Jan. 13, 2010 (JP) ..... 2010-005265

(51) Int. Cl.
*G03G 15/02* (2006.01)

(52) U.S. Cl. ..... 399/100; 399/176

(58) Field of Classification Search ..... 399/100, 399/174, 176
See application file for complete search history.

(56) References Cited

U.S. PATENT DOCUMENTS 6,263,175 B1 * 7/2001 Sawada et al. ..... 399/100

FOREIGN PATENT DOCUMENTS

| | | | |
|---|---|---|---|
| JP | 8-137208 A | | 5/1996 |
| JP | 2006-106352 A | | 4/2006 |
| JP | 2008-304729 | * | 8/2007 |

* cited by examiner

*Primary Examiner* — Hoang Ngo
(74) *Attorney, Agent, or Firm* — Sughrue Mion, PLLC

(57) ABSTRACT

A cleaning body includes: a shaft portion; and a porous member that is mounted to an outer periphery of the shaft portion at an incline with respect to an axial direction of the shaft portion, and in which plural cavities are formed, wherein the porous member has projecting portions that project toward a radial direction outer side of the shaft portion in a cross-section along the axial direction of the shaft portion, and the projecting portions contact a body to be cleaned and clean the body to be cleaned, and lengths, along a radial direction of the shaft portion, of the plural cavities are longer than lengths along the axial direction of the shaft portion.

5 Claims, 16 Drawing Sheets

CLEANING BODY, CLEANING DEVICE, CHARGING DEVICE, ASSEMBLY, AND IMAGE FORMING DEVICE

CROSS-REFERENCE TO RELATED APPLICATION

This application is based on and claims priority under 35 USC 119 from Japanese Patent Application No. 2010-5265 filed on Jan. 13, 2010.

BACKGROUND

1. Technical Field

The present invention relates to a cleaning body, a cleaning device, a charging device, an assembly, and an image forming device.

2. Summary

A first aspect of the present invention is a cleaning body having: a shaft portion; and a porous member that is mounted to an outer periphery of the shaft portion at an incline with respect to an axial direction of the shaft portion, and in which a plurality of cavities are formed, wherein the porous member has projecting portions that project toward a radial direction outer side of the shaft portion in a cross-section along the axial direction of the shaft portion, and the projecting portions contact a body to be cleaned and clean the body to be cleaned, and lengths, along a radial direction of the shaft portion, of the plurality of cavities are longer than lengths along the axial direction of the shaft portion.

BRIEF DESCRIPTION OF THE DRAWINGS

Exemplary embodiments of the present invention will be described in detail based on the following figures, wherein.

DETAILED DESCRIPTION

An example of an exemplary embodiment relating to the present invention is described hereinafter on the basis of the drawings.

(Structure of Image Forming Device relating to the Present Exemplary Embodiment)

Figure 1:
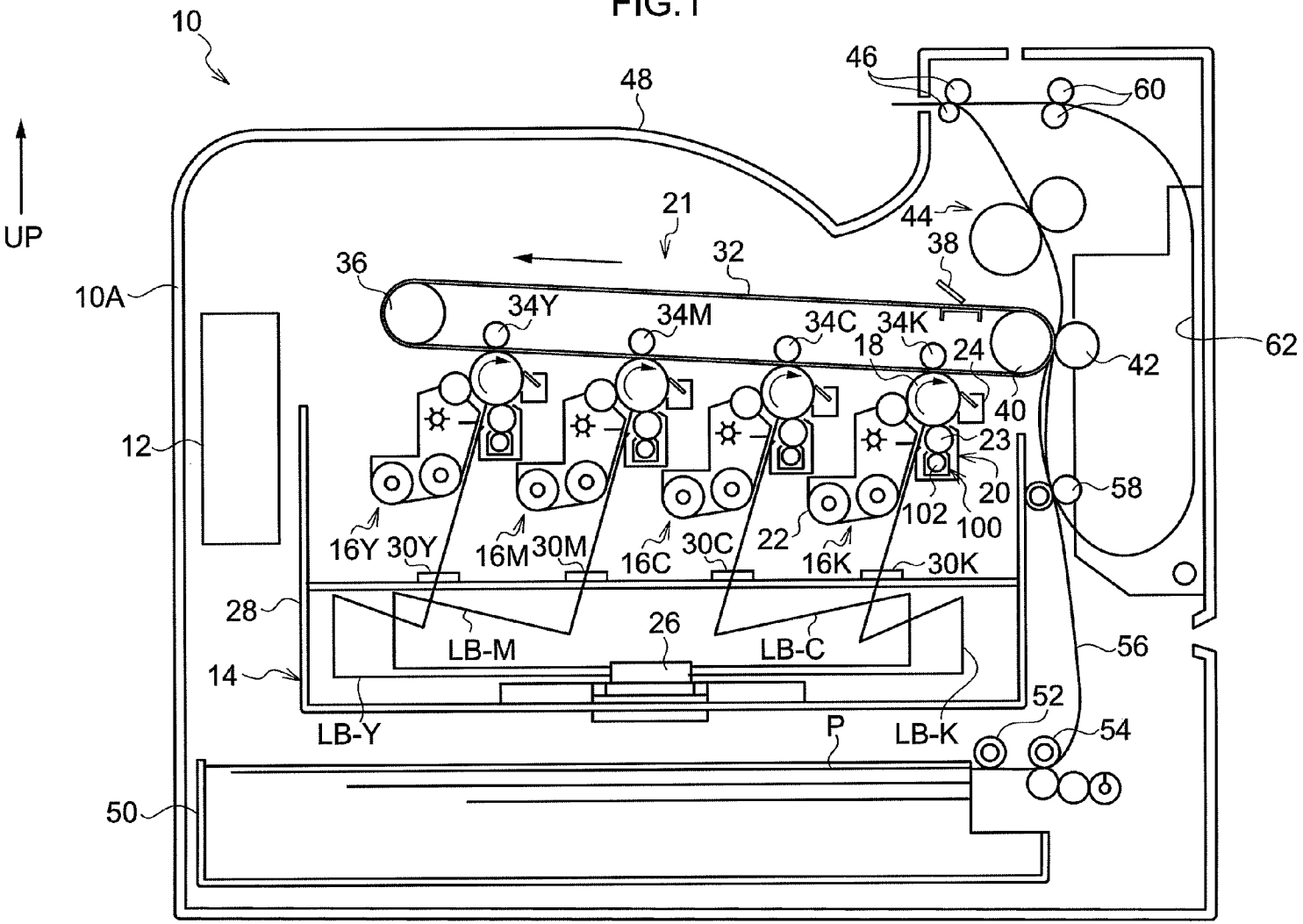
FIG. 1 is a schematic drawing showing the structure of an image forming device relating to an exemplary embodiment.

First, the structure of an image forming device relating to the present exemplary embodiment will be described. FIG. 1 is a schematic drawing showing the structure of the image forming device relating to the present exemplary embodiment. Note that arrow UP shown in the drawings indicates the vertically upward direction.

As shown in FIG. 1, an image processing section 12, that carries out image processings on inputted image data, is provided within a device main body 10A of an image forming device 10.

The image processing section 12 processes inputted image data into gradation data of the four colors of yellow (Y), magenta (M), cyan (C), black (K). An exposure device 14, that receives the processed gradation data and carries out image exposure by laser lights LB, is provided in the center of the device main body 10A.

Four image forming units 16Y, 16M, 16C, 16K of yellow (Y), magenta (M), cyan (C), black (K) are disposed at uniform intervals in the horizontal direction, above the exposure device 14. Note that there are cases in which the Y, M, C, K is omitted when there is no need to provide description that differentiates among Y, M, C, K.

These four image forming units 16Y, 16M, 16C, 16K are all structured similarly, and are each structured to include: an image holding body 18 that serves as an example of a body to be charged and is shaped as a solid cylinder and is driven to rotate; a charging device 20 that charges the outer peripheral surface of the image holding body 18; a developing device 22 that develops, by a toner of the corresponding color, an electrostatic latent image that has been formed by the image exposure of the exposure device 14 on the outer peripheral surface of the image holding body 18 that has been charged by the charging device 20, and makes the image visible as a toner image; and a cleaning member 24 that cleans the outer peripheral surface of the image holding body 18.

The image holding body 18 is structured so as to be able to hold a formed image, and more concretely, is a photoreceptor. The charging device 20 is structured to include a charging roller 23 serving as an example of a charging body that charges the outer peripheral surface of the image holding body 18, and a cleaning device 100 that cleans the charging roller 23.

The charging roller 23 contacts the outer peripheral surface of the image holding body 18 and rotates, and charges the outer peripheral surface of the image holding body 18. Note that the charging roller 23 is an example of a body to be cleaned that is cleaned by the cleaning device 100. The concrete structure of the cleaning device 100 is described below.

The respective image forming units 16Y, 16M, 16C, 16K are structured so as to be detachable with respect to the device main body 10A, and function as assemblies that are detachably assembled integrally with the device main body 10A. Note that it suffices for the assembly to include at least the image holding body 18, the charging roller 23 and the cleaning device 100.

Further, the image forming units 16Y, 16M, 16C, 16K may be structured so as to not be made into units and so as to, for example, be supported at a common supporting frame and not be detached from the device main body 10A.

Four semiconductor lasers, that are not illustrated and that are structured commonly for the four image forming units 16Y, 16M, 16C, 16K, are provided at the exposure device 14. Laser lights LB-Y, LB-M, LB-C, LB-K are emitted from these semiconductor lasers in accordance with gradation data.

The laser lights LB-Y, LB-M, LB-C, LB-K that exit from the semiconductor lasers are illuminated, via unillustrated f-θ lenses, onto a polygon mirror 26 that is a rotating polygon mirror, and are deflected and scanned by the polygon mirror 26. The laser lights LB-Y, LB-M, LB-C, LB-K, that have been deflected and scanned by the polygon mirror 26, are, via imaging lenses and plural mirrors that are not illustrated, scanned and exposed from obliquely downward onto exposure points on the image holding bodies 18.

The periphery of the exposure device 14 is tightly closed by a parallelepiped casing 28. Light-transmitting members 30Y, 30M, 30C, 30K, that transmit the four laser lights LB-Y, LB-M, LB-C, LB-K toward the image holding bodies 18 of the image forming units 16Y, 16M, 16C, 16K, are provided at the top portion of the casing 28.

A primary transfer unit 21 is provided above the respective image forming units 16Y, 16M, 16C, 16K. The primary transfer unit 21 is structured to include: an endless intermediate transfer belt 32; a driving roller 40 around which the intermediate transfer belt 32 is trained, and that is driven and rotated so as to circulate the intermediate transfer belt 32 in the direction of the arrow; a tension imparting roller 36 around which the intermediate transfer belt 32 is trained, and that imparts tension to the intermediate transfer belt 32; a cleaning member 38 that cleans the outer peripheral surface of the intermediate transfer belt 32; and primary transfer rollers 34Y, 34M, 34C, 34K that are disposed at the opposite sides of the image holding bodies 18Y, 18M, 18C, 18K with the intermediate transfer belt 32 nipped therebetween.

The toner images of the respective colors of yellow (Y), magenta (M), cyan (C), black (K), that have been successively formed on the image holding bodies 18 of the image forming units 16Y, 16M, 16C, 16K, are transferred onto the intermediate transfer belt 32 so as to be superposed one on another by the four primary transfer rollers 34Y, 34M, 34C, 34K.

A secondary transfer roller 42 is provided at the opposite side of the driving roller 40, with the intermediate transfer belt 32 nipped therebetween. The toner images of the respective colors of yellow (Y), magenta (M), cyan (C), black (K), that have been transferred onto the intermediate transfer belt 32 so as to be superposed one on another, are conveyed by the intermediate transfer belt 32, are nipped by the driving roller 40 and the secondary transfer roller 42, and are secondarily-transferred onto a recording medium P that is conveyed along a conveying path 56.

A fixing device 44 that fixes the toner image, that has been transferred on the recording medium P, onto the recording medium P by heat and pressure, is provided at the recording medium P conveying direction downstream side (hereinafter simply called downstream side) of the secondary transfer roller 42.

Ejecting rollers 46 are provided at the downstream side of the fixing device 44. The ejecting rollers 46 eject the recording medium P, on which the toner image has been fixed, out to an ejecting section 48 that is provided at the top portion of the device main body 10A of the image forming device 10.

On the other hand, an accommodating portion 50 in which the recording media P are accommodated is provided at the lower side of the interior of the device main body 10A of the image forming device 10. A feed roller 52 that sends the recording medium P, that is accommodated in the accommodating portion 50, out to the conveying path 56 is provided. A separating roller 54, that separates the recording media P one-by-one and conveys the recording medium P, is provided at the downstream side of the feed roller 52. A registration roller 58, that adjusts the conveying timing, is provided at the downstream side of the separating roller 54. Due thereto, the recording medium P, that is sent-out from the accommodating portion 50, is conveyed to the position at which the intermediate transfer belt 32 and the secondary transfer roller 42 contact one another (a secondary transfer position) by the registration roller 58 at a predetermined timing.

Conveying rollers 60 are provided next to the ejecting rollers 46. The conveying rollers 60 convey the recording medium P, on whose one side an image has been fixed by the fixing device 44, to a conveying path 62 for double-sided (duplex) printing, without the recording medium P being ejected-out onto the ejecting section 48 by the ejecting rollers 46. Due thereto, the recording medium P that is conveyed along the conveying path 62 for double-sided printing is, in a state in which the obverse and reverse thereof are inverted, again conveyed to the registration roller 58. This time, a toner image is transferred and fixed onto the reverse of the recording medium P, and the recording medium P is ejected onto the ejecting section 48.

Due to this structure, an image is formed on the recording medium P as follows.

First, gradation data of the respective colors is successively outputted from the image processing section 12 to the exposure device 14. The laser lights LB-Y, LB-M, LB-C, LB-K, that are emitted from the exposure device 14 in accordance with the gradation data, are scanned and exposed onto the outer peripheral surface of the image holding bodies 18 that have been charged by the charging devices 20 (the charging rollers 23), such that electrostatic latent images are formed on the outer peripheral surfaces of the image holding bodies 18. The electrostatic latent images formed on the image holding bodies 18 are made visible as toner images of the respective colors of yellow (Y), magenta (M), cyan (C), black (K) respectively by the developing devices 22Y, 22M, 22C, 22K.

The toner images of the respective colors of yellow (Y), magenta (M), cyan (C), black (K) that are formed on the image holding bodies 18 are transferred in a superposed manner onto the intermediate transfer belt 32 that circulates, by the primary transfer rollers 34 of the primary transfer unit 21 that is disposed over the region above the image forming units 16Y, 16M, 16C, 16K.

The toner images of the respective colors, that have been transferred in a superposed manner onto the intermediate transfer belt 32 that circulates, are secondarily-transferred, by the secondary transfer roller 42, onto the recording medium P that is conveyed from the accommodating section 50 via the conveying path 56 by the feed roller 52, the separating roller 54 and the registration roller 58.

The recording medium P, on which the toner images have been transferred, is conveyed to the fixing device 44. The toner images transferred on the recording medium P are fixed to the recording medium P by the fixing device 44. After fixing, the recording medium P is ejected by the ejecting rollers 46 to the ejecting section 48 that is provided at the top portion of the device main body 10A of the image forming device 10.

If images are to be formed on both sides of the recording medium P, the conveying direction of the recording medium P, on whose one surface an image has been fixed by the fixing device 44, is switched without the recording medium P being ejected to the ejecting section 48 by the ejecting rollers 46, and the recording medium P is conveyed via the conveying rollers 60 to the conveying path 62 for double-sided printing. Due to the recording medium P being conveyed along the conveying path 62 for double-sided printing, the obverse and the reverse of the recording medium P are inverted, and the recording medium P is again conveyed to the registration roller 58. This time, toner images are transferred and fixed onto the reverse of the recording medium P. After the transferring and fixing, the recording medium P is ejected by the ejecting rollers 46 onto the ejecting section 48.

(Structure of Cleaning Device Relating to Present Exemplary Embodiment)

Figure 2:
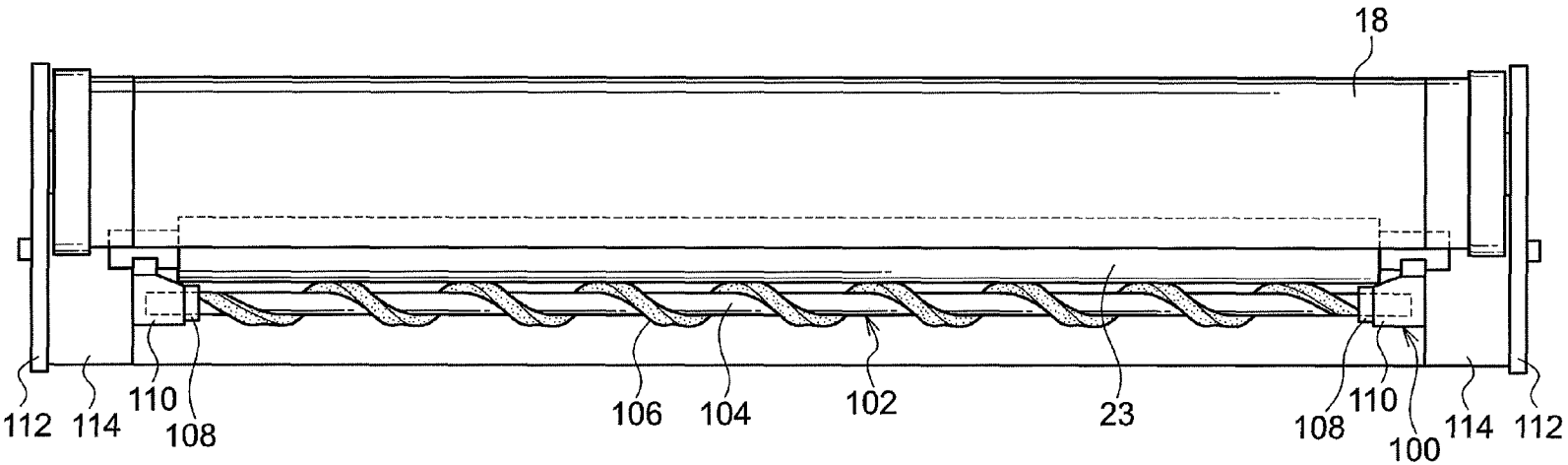
FIG. 2 is a schematic drawing showing the structure of a cleaning device relating to the present exemplary embodiment.

The structure of the cleaning device relating to the present exemplary embodiment is described next. FIG. 2 is a schematic drawing showing the structure of the cleaning device relating to the present exemplary embodiment.

As shown in FIG. 2, the cleaning device 100 relating to the present exemplary embodiment has a cleaning body 102 that cleans the charging roller 23 that serves as an example of a body to be cleaned. The cleaning body 102 has a shaft portion 104 that is disposed along the axial direction of the charging roller 23, and a foam member 106 that is spirally wound around the outer periphery of the shaft portion 104.

The shaft portion 104 is formed in the shape of a solid cylinder and of a metal material, and has a length along the axial direction of the charging roller 23.

The foam member 106 is structured as, for example, a sponge formed of urethane resin or the like, and is formed in the shape of a strip and is elastically deformable. The foam member 106 is fixed to the outer periphery of the shaft portion 104 from one axial direction end portion thereof to the other end portion by an adhesive material such as an adhesive, double-sided tape, or the like.

Figure 3:
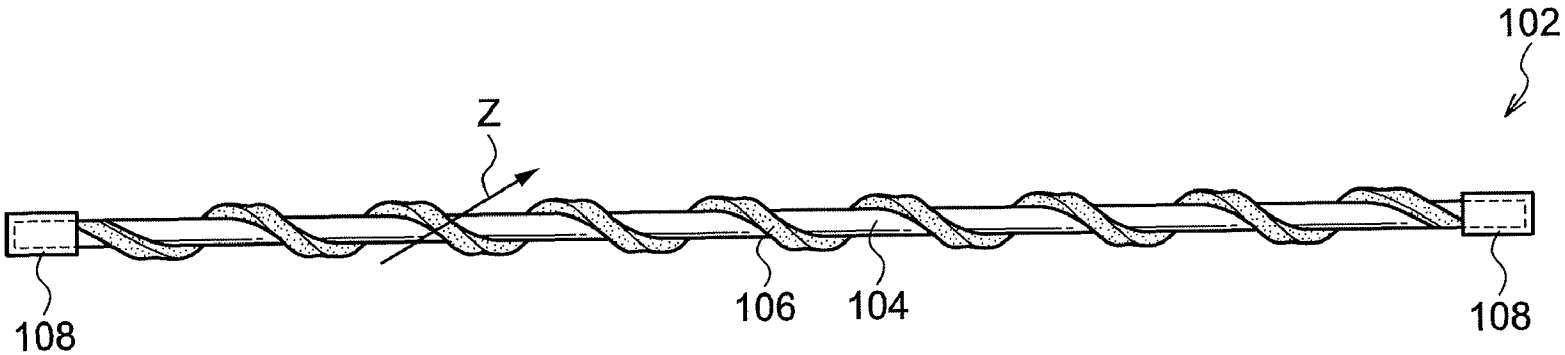
FIG. 3 is a schematic drawing showing the structure of a cleaning body relating to the present exemplary embodiment.

As shown in FIG. 3, pressing members 108, that are cylindrical-tube-shaped and that press the longitudinal direction end portions of the foam member 106 between the pressing members 108 and the shaft portion 104, are provided at the both axial direction end portions of the shaft portion 104 respectively. The pressing members 108 are fixed to the shaft portion 104, and rotate integrally with the shaft portion 104. As shown in FIG. 2, supporting members 110, that rotatably support the pressing members 108, are fixed to fixed portions 114 that are formed at side plates 112. Note that, in the present exemplary embodiment, the charging roller 23 is rotatably supported by the supporting members 110, and the image holding body 18 is supported so as to be rotatable with respect to the side plates 112.

Figure 4:
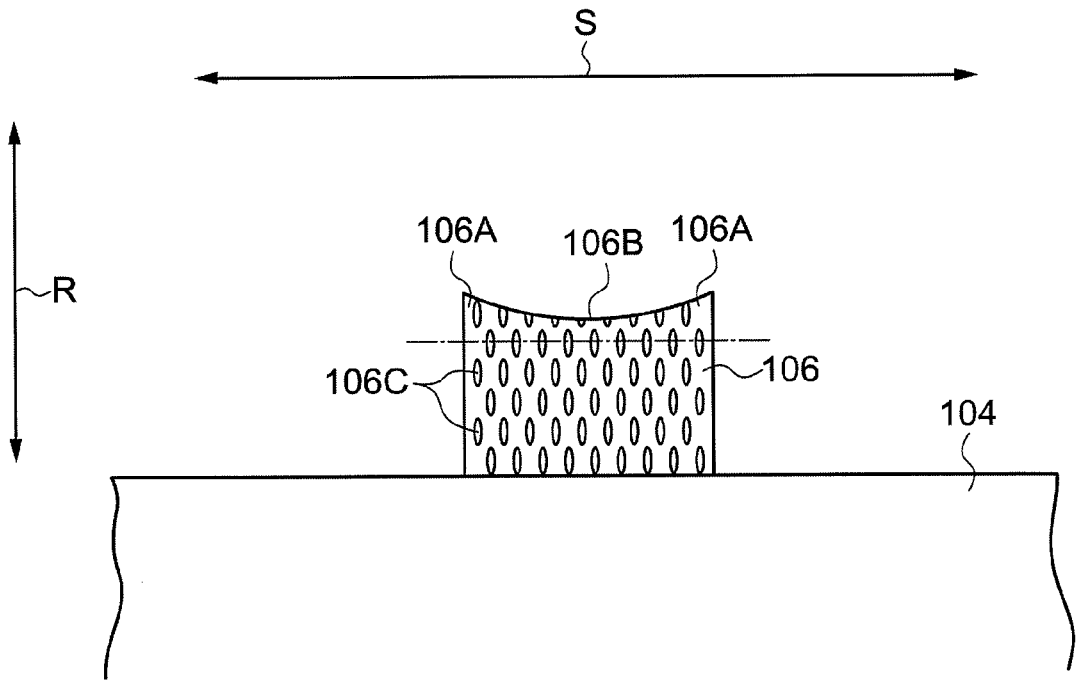
FIG. 4 is a drawing showing the cross-section, along the axial direction of a shaft portion, of a foam member relating to the present exemplary embodiment.

As shown in FIG. 4, in a cross-section along an axial direction S of the shaft portion 104, the foam member 106 is shaped as a quadrilateral that is enclosed by four sides (including a curve). At both end portions in the axial direction S of the shaft portion 104, the foam member 106 has projecting portions 106A that project toward the outer side in a radial direction R. The projecting portions 106A are formed by creating a difference in outer diameters between a central portion 106B at the outer peripheral surface (the top surface in FIG. 4) of the foam member 106 and the both end portions 106A by, for example, imparting tension to the foam member 106. Note that, also in the cross-section along the direction (Z direction in FIG. 3) orthogonal to the direction of winding thereof, the foam member 106 is similarly shaped as a quadrilateral that is enclosed by four sides (including a curve), and has, at the both end portions in the transverse direction, the projecting portions 106A that project toward the outer side in the radial direction R.

At the cleaning body 102, the projecting portions 106A and the outer peripheral surface (the top surface in FIG. 4) of the foam member 106 contact the charging roller 23, and the shaft portion 104 is slave-rotated. Due thereto, the outer peripheral surface of the foam member 106 wipes the outer peripheral surface of the charging roller 23 and the projecting portions 106A of the foam member 106 scrape foreign matter off, and the foreign matter is thereby removed.

Here, plural cavities (cells) 106C of the foam member 106 relating to the present exemplary embodiment, which cavities 106C are formed at the interior of the foam member 106 by foaming, have lengths (major axes) along the radial direction R of the shaft portion 104. Namely, the plural cavities (cells) 106C of the foam member 106 form a foam structure in which the lengths of the cavities 106C in the direction along (directed in) the radial direction R of the shaft portion 104 are longer than the lengths thereof along the axial direction S of the shaft portion 104. Note that, although there also exist, among the plural cavities (cells) 106C, cavities (cells) that differ from the above description, there are, overall, numerous cavities (cells) having lengths (major axes) that run along (are directed in) the aforementioned direction.

The method of manufacturing the cleaning body 102, in which the lengthwise direction of the cavities 106C of the foam member 106 is prescribed with respect to the shaft portion 104 in this way, is described hereinafter.

Figure 5:
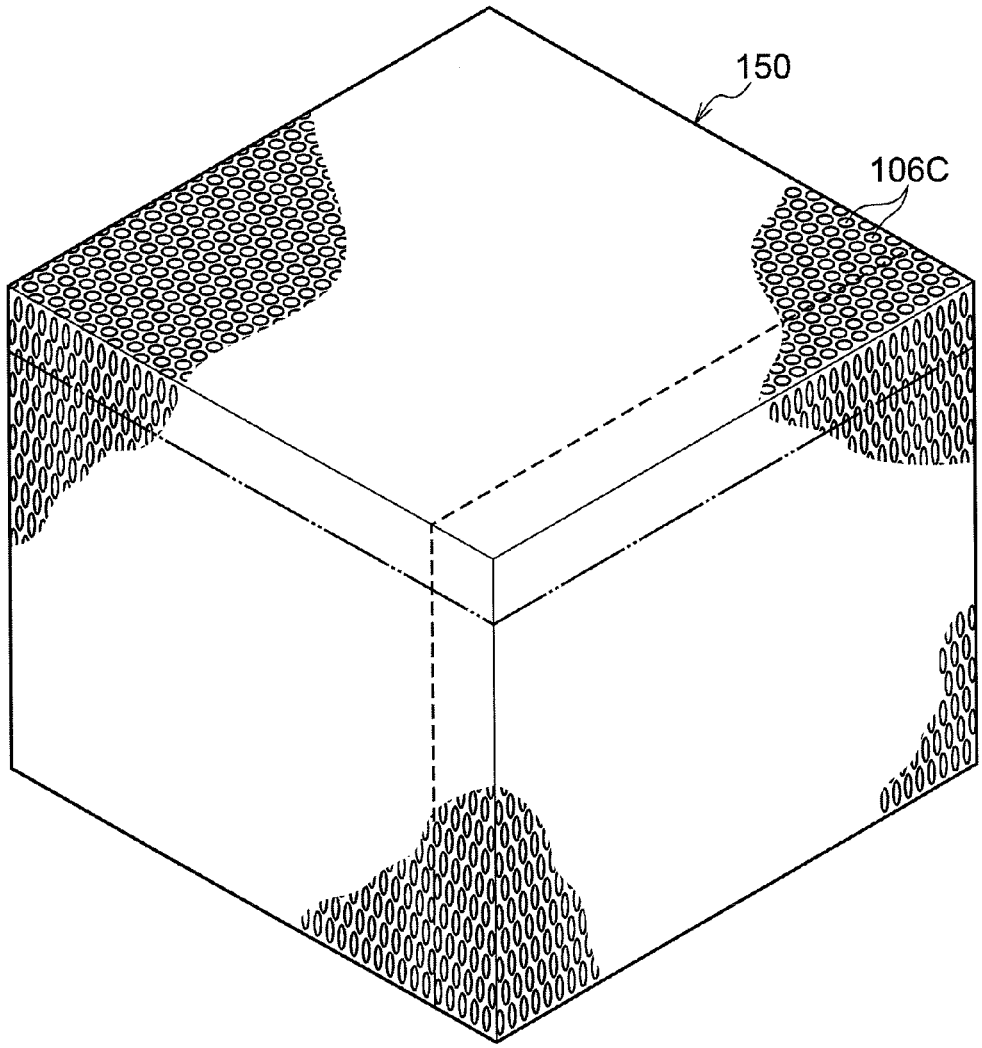
FIG. 5 is a perspective view showing a rolled web of the foam member relating to the present exemplary embodiment.

First, as shown in FIG. 5, a rolled web 150 of the foam member 106 is readied. In the rolled web 150, the cavities 106C are shaped, in side view, as holes having lengths in one direction (the vertical direction in FIG. 5), i.e., holes whose longitudinal direction is one specific direction, and are circular in plan view. Namely, the cavities 106C are shaped as oval bodies (like rugby balls).

Figure 6A:
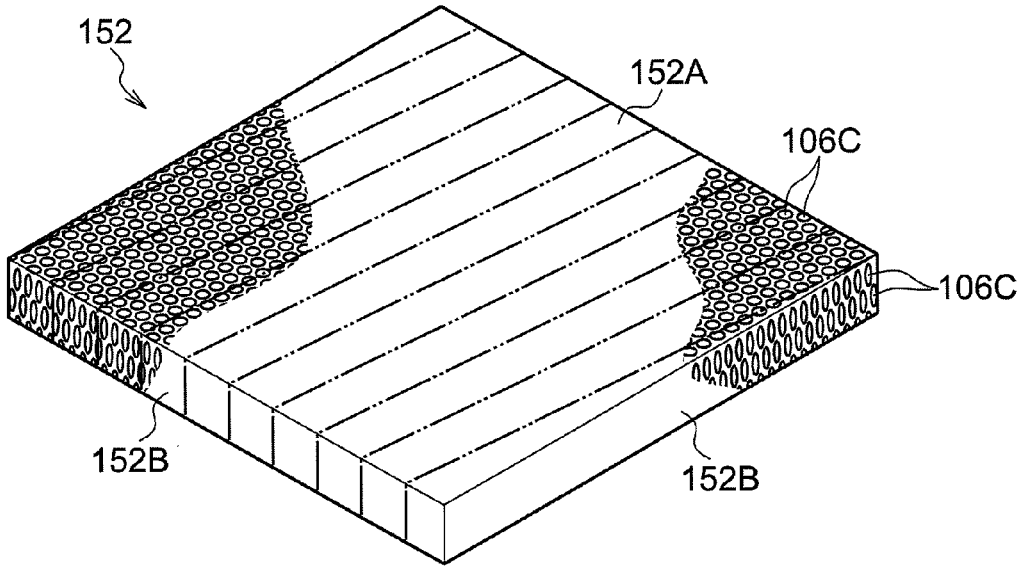
FIGS. 6A and 6B are perspective views showing a plate body that is cut-out from the rolled web shown in FIG. 5.

Next, as shown in FIG. 6A, a plate body 152 is cut-out from the rolled web 150. At this time, the plate body 152 is cut-out by cutting the rolled web 150 along the two-dot chain line in FIG. 5, such that the cavities 106C are circular when viewing a plate surface (top/bottom surface in FIG. 6A) 152A of the plate body 152 in plan view, and the cavities 106C are shaped as long holes when viewing an end surface 152B in side view.

Figure 6B:
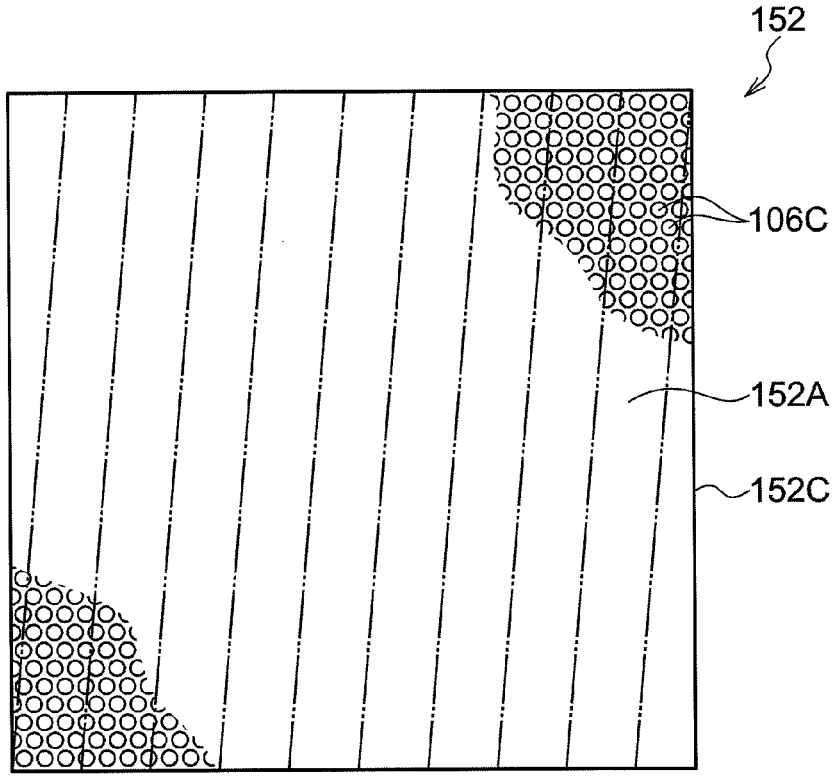
Figure 7:
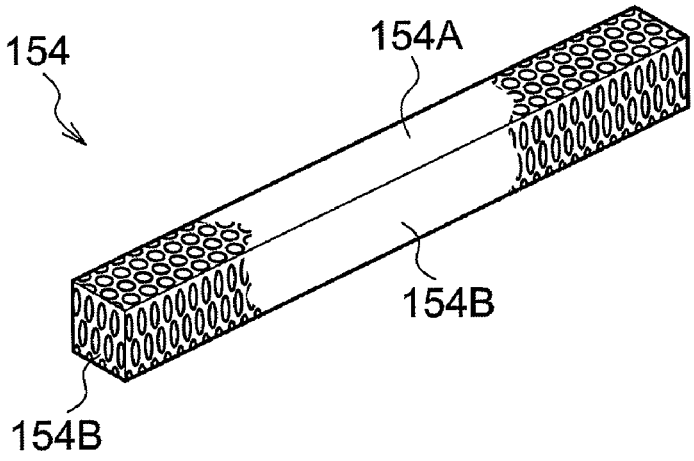
FIG. 7 is a perspective view showing a strip body that is cut-out from the plate body shown in FIGS. 6A and 6B.

Next, as shown in FIG. 7, a strip body 154 is cut-out from the plate body 152. At this time, the strip body 154 is cut-out such that the cavities 106C are circular when a strip surface (top/bottom surface in FIG. 7) 154A of the strip body 154 is viewed in plan view, and the cavities 106C are shaped as long holes when a side surface 154B and an end surface 154C are viewed in side view. Further, by cutting the strip body 154 out at an incline with respect to a side end 152C of the plate body 152 as shown in FIG. 6B, the strip body 154 is formed as a parallelogram (other than a square or a rectangle) as seen in plan view. Making the strip body 154 be a parallelogram in this way is in order for the end portions of the strip body 154 and the axial direction end portions of the shaft portion 104 to be made uniform when the strip body 154 is wound around the shaft portion 104 as described below (refer to the right end portion of the shaft portion 104 in FIG. 8). Note that the strip body 154 may be cut-out in a rectangular shape.

Figure 8:
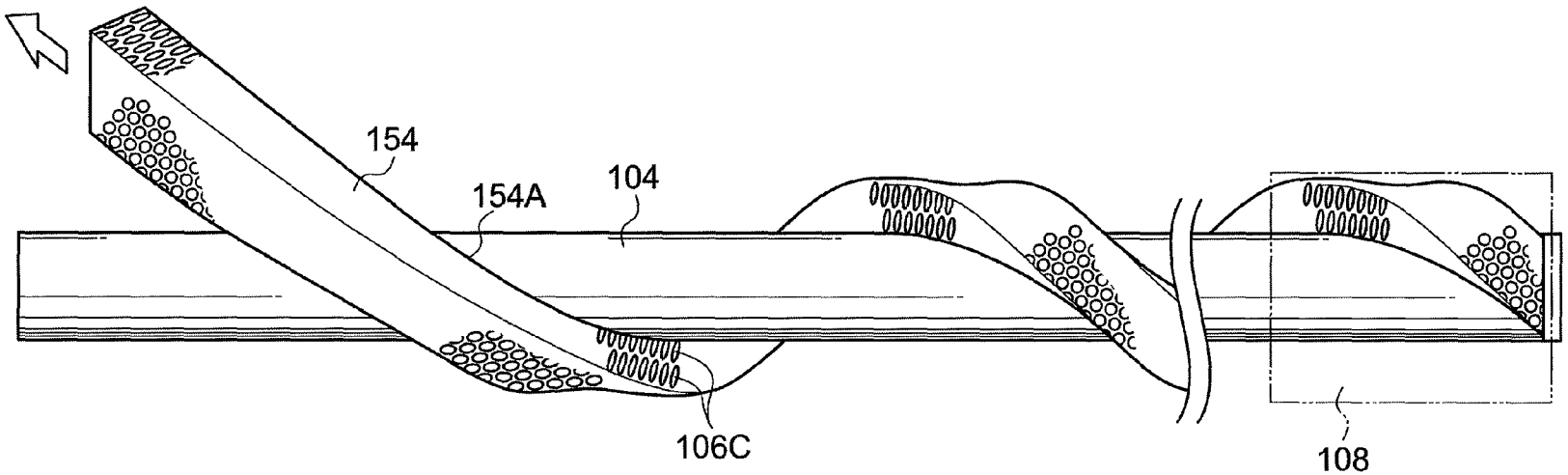
FIG. 8 is a perspective view showing a state in which the strip body shown in FIG. 7 is wound around the shaft portion.

Next, as shown in FIG. 8, the strip body 154 is spirally wound around the shaft portion 104. At this time, the strip body 154 is wound around the shaft portion 104 such that the strip surface 154A of the strip body 154 faces the outer peripheral surface of the shaft portion 104. The strip surface 154A of the strip body 154 is adhered to the outer periphery of the shaft portion 104 by an adhesive material such as an adhesive, double-sided tape, or the like.

Next, the pressing members 108 are mounted to the both axial direction end portions of the shaft portion 104, and the both longitudinal direction end portions of the strip body 154 wound on the shaft portion 104 are pressed. The cleaning body 102 is thereby manufactured.

Note that cleaning bodies relating to comparative examples, in which the plural cavities 106C of the foam member 106 have lengths (major axes) along the axial direction S (see FIG. 9) or the peripheral direction C (see FIG. 12) of the shaft portion 104, are manufactured by varying the method of cutting-out from the rolled web 150 as described hereinbelow.

Figure 10A:
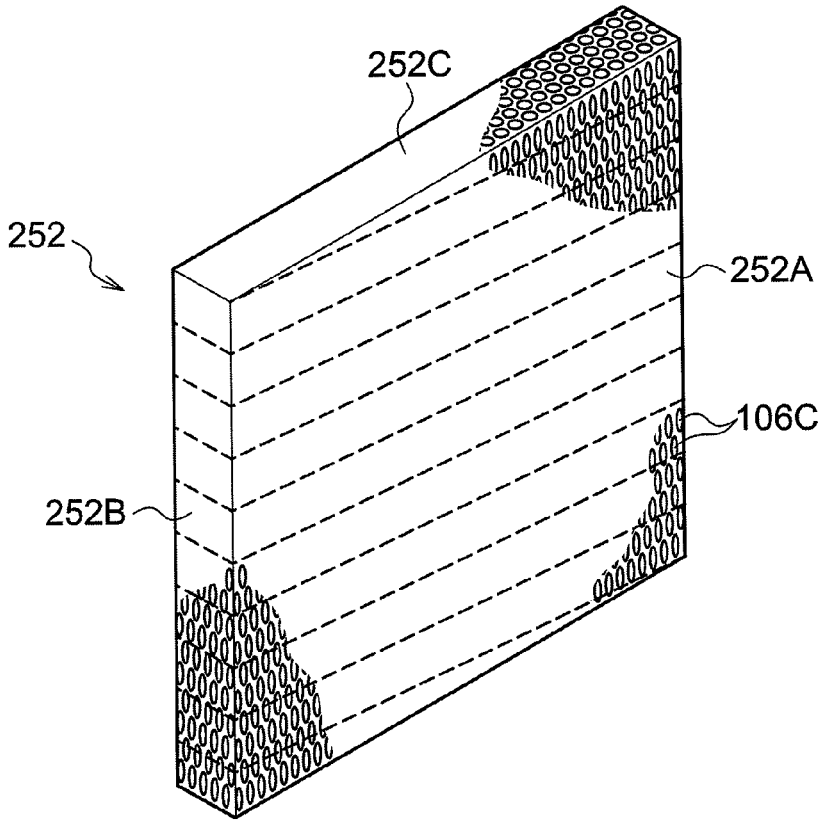
FIGS. 10A and 10B are perspective views showing a plate body and a strip body that are cut-out from a rolled web, in the comparative example shown in FIG. 9.
Figure 13A:
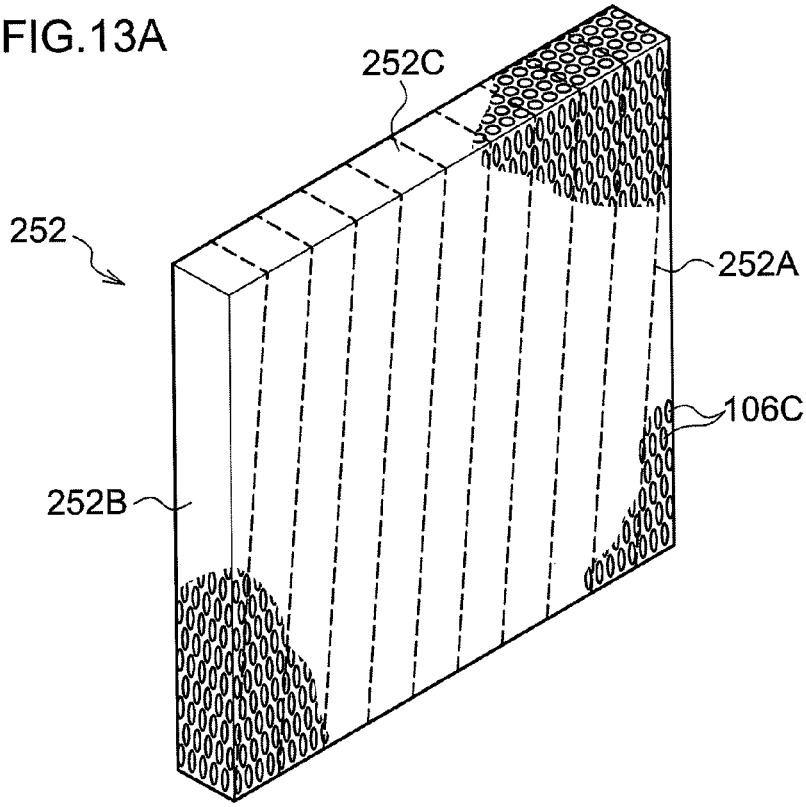
FIGS. 13A and 13B are perspective views showing a plate body and a strip body that are cut-out from a rolled web, in the comparative example shown in FIG. 12.

First, as shown in FIG. 10A and FIG. 13A, a plate body 252 is cut-out from the rolled web 150. By cutting the rolled web 150 along the dashed line in FIG. 5 at this time, the plate body 252 is cut-out such that the cavities 106C are shaped as long holes when viewing a plate surface (the side surface in FIG. 10A and FIG. 13A) 252A and a side end surface 252B of the plate body 252 in side view, and the cavities 106C are circular when viewing a top/bottom end surface 252C in plan view.

Figure 9:
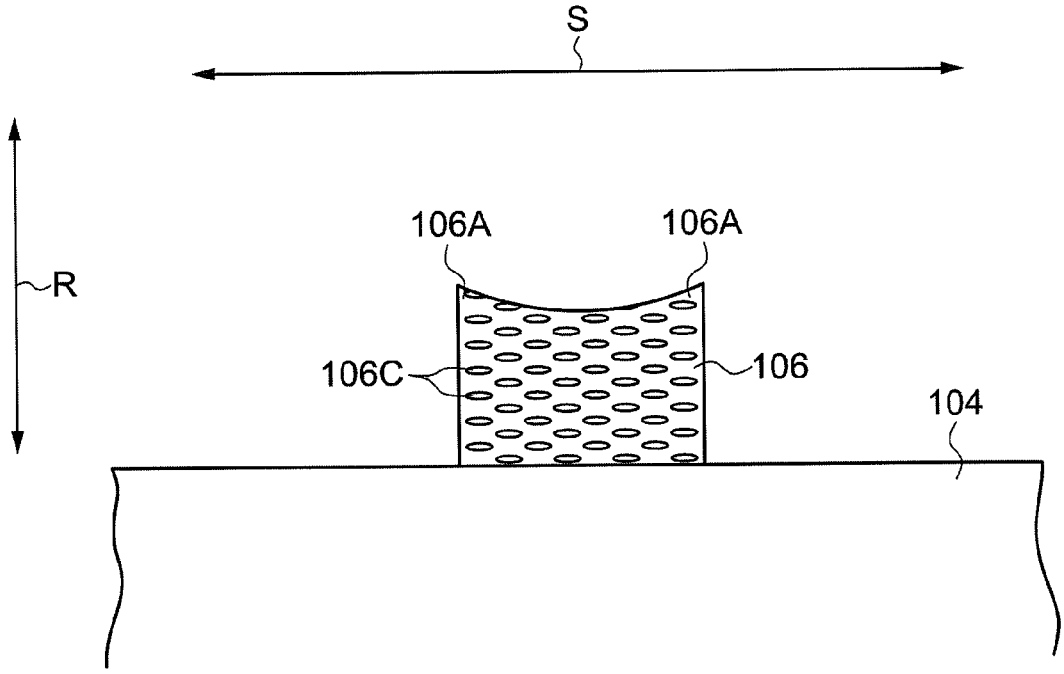
FIG. 9 is a drawing showing the cross-section of a foam member of a comparative example in which plural cavities have lengths (major axes) along the axial direction of the shaft portion.
Figure 10B:
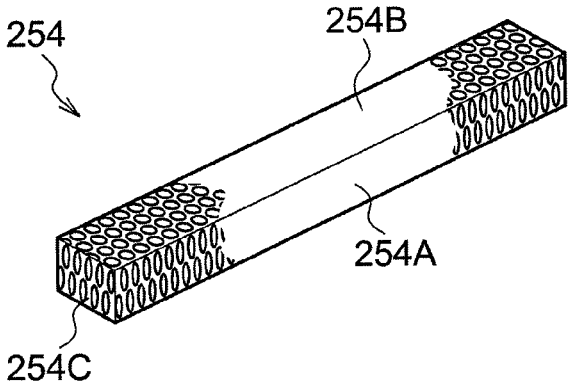

Next, in the comparative example shown in FIG. 9, a strip body 254 is cut-out from the plate body 252 such that, as shown in FIG. 10B, the cavities 106C have lengths (major axes) along the widthwise direction of the strip body 254 when a strip surface 254A and an end surface 254C of the strip body 254 are viewed in side view, and the cavities 106C are circular when a top/bottom surface 254B in FIG. 10B is viewed in plan view.

Figure 11:
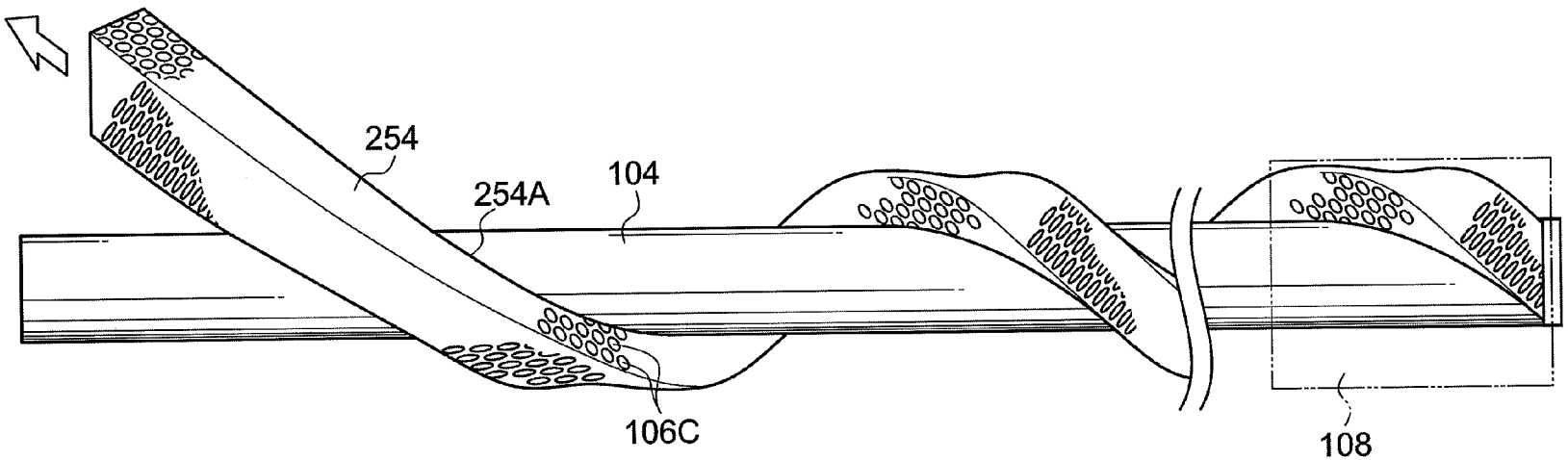
FIG. 11 is a perspective view showing a state in which the strip body shown in FIGS. 10A and 10B is wound around the shaft portion.

Next, as shown in FIG. 11, the strip body 254 is spirally wound around the shaft portion 104. At this time, the strip body 254 is wound around the shaft portion 104 such that the strip surface 254A of the strip body 254 faces the outer peripheral surface of the shaft portion 104. The strip body 254 is adhered to the outer periphery of the shaft portion 104 by an adhesive material such as an adhesive, double-sided tape, or the like.

Next, the pressing members 108 are mounted to the both axial direction end portions of the shaft portion 104, and the both longitudinal direction end portions of the strip body 254 wound on the shaft portion 104 are pressed. A cleaning body relating to the comparative example shown in FIG. 9 is thereby manufactured.

Figure 12:
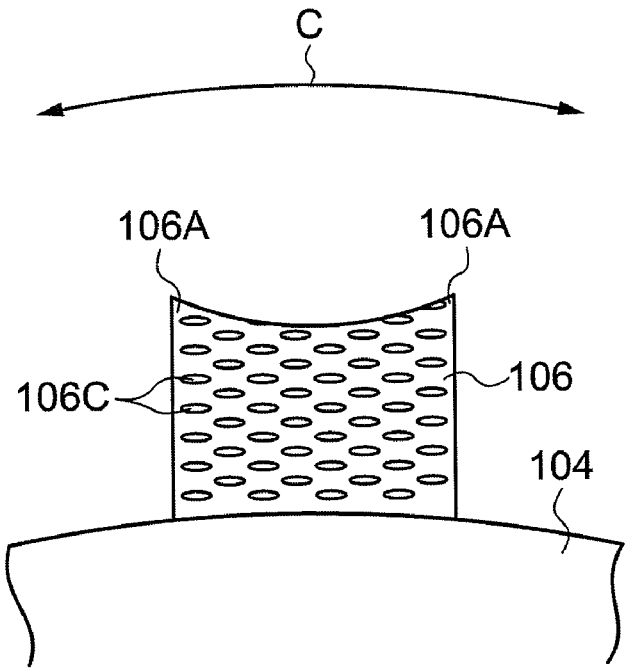
FIG. 12 is a drawing showing the cross-section of a foam member of a comparative example in which plural cavities have lengths (major axes) along the peripheral direction of the shaft portion.
Figure 13B:
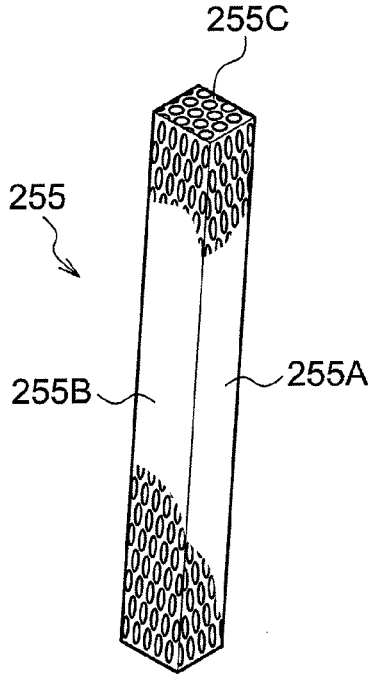

On the other hand, in the comparative example shown in FIG. 12, a strip body 255 is cut-out from the plate body 252 such that, as shown in FIG. 13B, the cavities 106C have lengths along the longitudinal direction of the strip body 255 when a strip surface 255A and a side surface 255B of the strip body 255 are viewed in side view, and the cavities 106C are circular when an end surface 255C is viewed in plan view.

Figure 14:
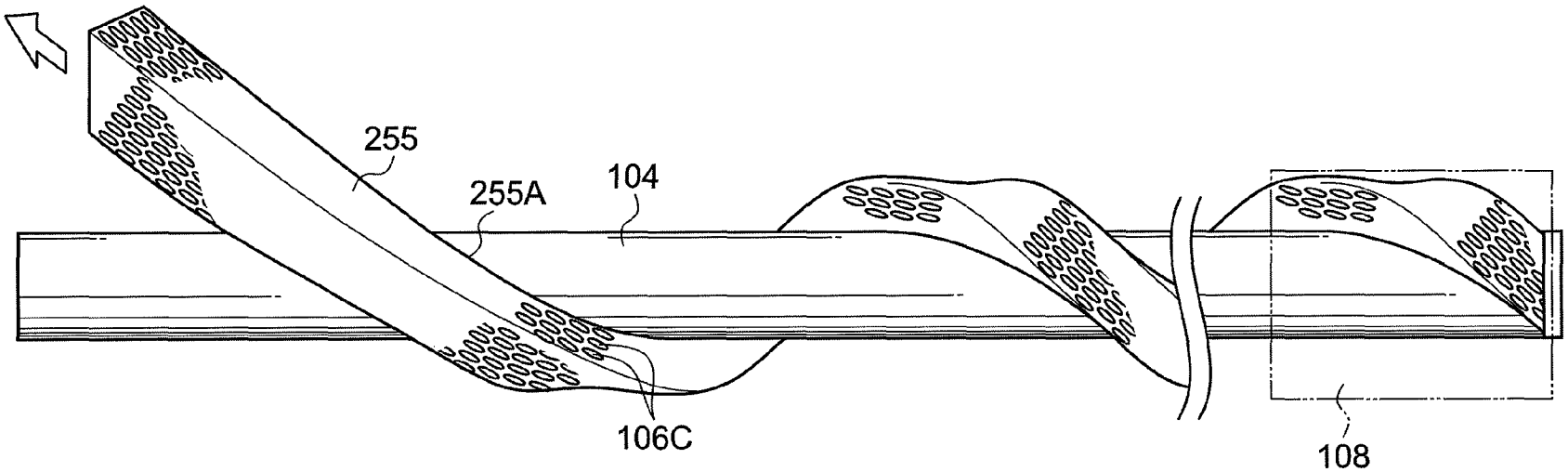
FIG. 14 is a perspective view showing a state in which the strip body shown in FIGS. 13A and 13B is wound around the shaft portion.

Next, as shown in FIG. 14, the strip body 255 is spirally wound around the shaft portion 104. At this time, the strip body 255 is wound around the shaft portion 104 such that the strip surface 255A of the strip body 255 faces the outer peripheral surface of the shaft portion 104. The strip body 255 is adhered to the outer periphery of the shaft portion 104 by an adhesive material such as an adhesive, double-sided tape, or the like.

Next, the pressing members 108 are mounted to the both axial direction end portions of the shaft portion 104, and the both longitudinal direction end portions of the strip body 255 wound on the shaft portion 104 are pressed. A cleaning body relating to the comparative example shown in FIG. 12 is thereby manufactured.

(Operation of Present Exemplary Embodiment)

The operation of the present exemplary embodiment is described next.

In the present exemplary embodiment, foreign matter, such as developer that remains on the image holding body 18 without being transferred onto the intermediate transfer belt 32, and the like, is removed from the image holding body 18 by the cleaning member 24.

Foreign matter, such as external additives and the like whose particle diameters are relatively small among the components of the developer, slips-past the cleaning member 24. The foreign matter such as external additives and the like that slips-past the cleaning member 24 adheres to the surface of the charging roller 23.

The foreign matter that has adhered to the surface of the charging roller 23 is removed by the projecting portions 106A and the outer peripheral surface (the top surface in FIG. 4) of the foam member 106 contacting the charging roller 23, and this outer peripheral surface of the foam member 106 wiping the outer peripheral surface of the charging roller 23 and the projecting portions 106A of the foam member 106 scraping the foreign matter off.

Figure 15A:
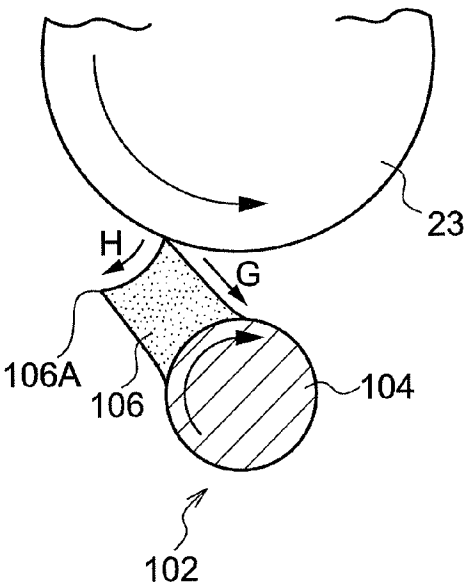
FIGS. 15A, 15B and 15C are explanatory drawings for explaining cleaning operation of the cleaning body.
Figure 15B:
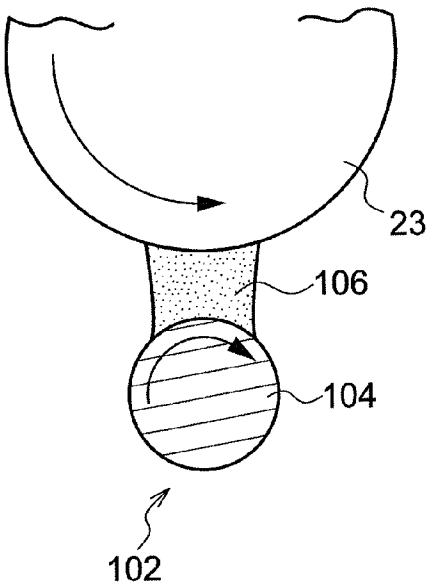
Figure 15C:
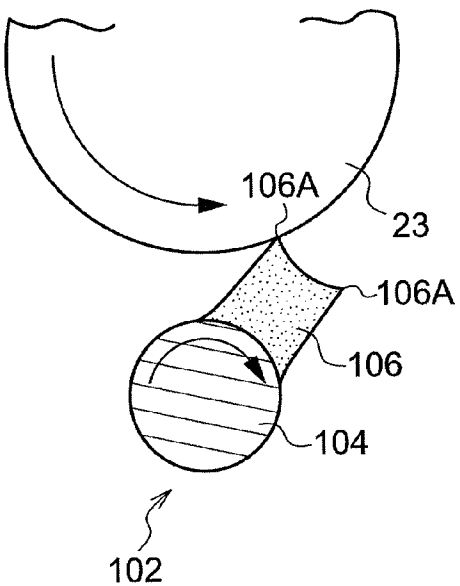

Specifically, as shown in FIGS. 15A and 15B, the foreign matter, such as external additives and the like that has adhered to the outer peripheral surface of the charging roller 23 that rotates in the direction of the arrow, is pushed and cohered by the foam member 106 due to the projecting portions 106A at the foam member 106 of the cleaning body 102 that is slave-rotated being pushed by the outer peripheral surface of the charging roller 23 and elastically deforming (elastically compressing) in the heightwise direction (direction G shown in FIG. 15A) and the widthwise direction (direction H shown in FIG. 15A) of the foam member 106. Then, as shown in FIG. 15C, the projecting portion 106A at the foam member 106 of the cleaning body 102 that is slave-rotated is restored, and due to this restoring force, the cohered foreign matter such as external additives and the like is loosened from the dense state and is repelled from the outer peripheral surface of the charging roller 23.

Here, in the present exemplary embodiment, the plural cavities 106C that are formed within the foam member 106 by the foaming have lengths (major axes) along the radial direction R of the shaft portion 104. Therefore, the rigidity (strength) of the projecting portions 106A improves as compared with the comparative examples in which the plural cavities 106C have lengths along the axial direction S (see FIG. 9) or the peripheral direction C (see FIG. 12) of the shaft portion 104. This is because the proportion of the pillar portions (the portions other than the cavities 106C) in the sectional surface area when a cross-section is taken along the one-dot chain line shown in FIG. 4, is larger than in the cases of the comparative examples. Namely, the proportion that is occupied by the pillar portions (the portions other than the cavities 106C), that receive the compressive load from the charging roller 23, is greater than in the cases of the comparative examples.

Due to the strength of the projecting portions 106A improving, the contact pressure of the projecting portions 106A with respect to the charging roller 23 increases, and the ability to clean the charging roller 23 improves. Further, overall sagging of the foam member 106 also is suppressed, and the life of the foam member 106 is extended.

Note that, in the above-described exemplary embodiment, the cleaning device 100 is provided with respect to the charging roller 23. However, the cleaning device 100 may be provided for another member such as, for example, the primary transfer roller 34, the secondary transfer roller 42, the image holding body 18, or the obverse or reverse of the intermediate transfer belt 32.

Figure 16:
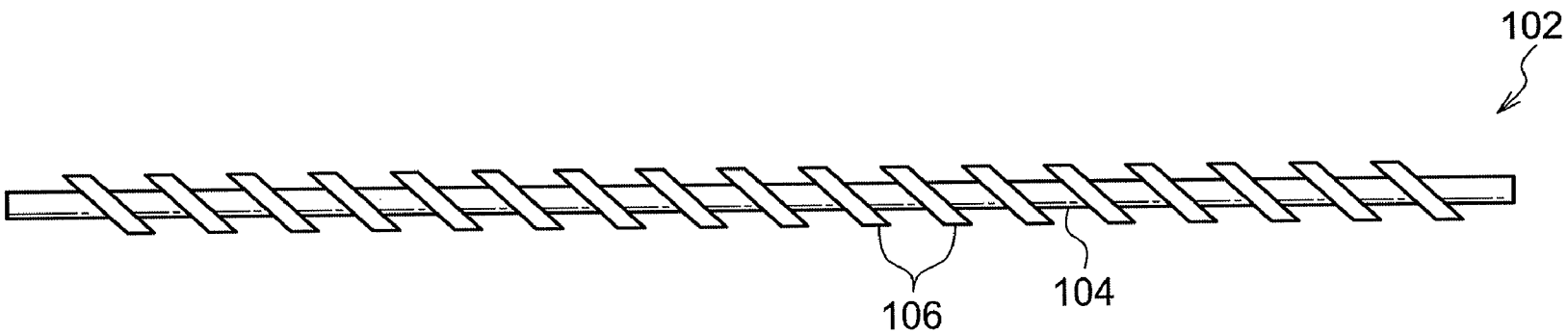
FIG. 16 is a schematic drawing showing a modified example in which the foam member is formed in annular shapes.

Further, in the above-described exemplary embodiment, the foam member 106 is spirally wound in continuation from one axial direction end portion of the shaft portion 104 to the other end portion. However, provided that the foam member 106 is mounted to the outer periphery of the shaft portion 104 at an incline with respect to the axial direction of the shaft portion 104, the foam member 106 may be, for example, divided into plural parts between the axial direction one end portion and the other end portion of the shaft portion 104 and wound around the shaft portion 104. Further, provided that the foam member 106 is mounted to the outer periphery of the shaft portion 104 at an incline with respect to the axial direction of the shaft portion 104, the foam member 106 may be, for example, plural foam members that are formed annularly so as to encircle the entire periphery of the shaft portion 104 as shown in FIG. 16. In this case, the foam members may be formed by, for example, cutting a foam material, that is formed in the shape of a cylindrical tube, at an incline with respect to the axial direction thereof.

The present invention is not limited to the above-described exemplary embodiments, and various modifications, changes, and improvements may be made thereto.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning body comprising:

a shaft portion; and a porous member that is mounted to an outer periphery of the shaft portion at an incline with respect to an axial direction of the shaft portion, and in which a plurality of cavities are formed, wherein the porous member has projecting portions that project toward a radial direction outer side of the shaft portion in a cross-section along the axial direction of the shaft portion, and the projecting portions contact a body to be cleaned and clean the body to be cleaned, and lengths, along a radial direction of the shaft portion, of the plurality of cavities are longer than lengths along the axial direction of the shaft portion.

2. A cleaning device comprising:

the cleaning body of claim 1 that is slave-rotated due to the projecting portions of the porous member contacting the body to be cleaned that rotates, and that cleans the body to be cleaned; and a supporting member that supports the shaft portion of the cleaning body rotatably.

3. A charging device comprising:

the cleaning device of claim 2; and a charging body that serves as the body to be cleaned that rotates.

4. An assembly comprising:

the cleaning device of claim 2;

a body to be charged; and a charging body that charges the body to be charged, and that serves as the body to be cleaned that rotates, wherein the assembly is integrally assembled detachably at a device main body.

5. An image forming device comprising:

the cleaning device of claim 2;

an image holding body that can hold an image;

a charging body that charges the image holding body, and that serves as the body to be cleaned that rotates;

an exposure device that exposes the image holding body that has been charged by the charging body, and forms an electrostatic latent image; and a developing device that develops the electrostatic latent image formed on the image holding body by the exposure device.

* * * * *